US010434567B2

(12) United States Patent
Young

(10) Patent No.: US 10,434,567 B2
(45) Date of Patent: Oct. 8, 2019

(54) SYSTEM FOR MAKING THIN FLOOR PLATE

(71) Applicant: Nucor Corporation, Charlotte, NC (US)

(72) Inventor: Eric Young, Blytheville, AR (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 16/123,243

(22) Filed: Sep. 6, 2018

(65) Prior Publication Data

US 2019/0015894 A1 Jan. 17, 2019

Related U.S. Application Data

(63) Continuation of application No. 14/963,305, filed on Dec. 9, 2015, now Pat. No. 10,099,279.

(60) Provisional application No. 62/094,920, filed on Dec. 19, 2014.

(51) Int. Cl.

| | |
|---|---|
| ***B22D 11/06*** | (2006.01) |
| ***E04F 15/02*** | (2006.01) |
| ***B21B 1/46*** | (2006.01) |
| ***E04F 15/06*** | (2006.01) |

(52) U.S. Cl.

CPC ..... *B22D 11/0622* (2013.01); *B21B 1/46* (2013.01); *E04F 15/02161* (2013.01); *E04F 15/06* (2013.01)

(58) Field of Classification Search

CPC ..... E04F 15/02172; E04F 15/06; B22D 11/0622; B22D 11/1206; B21B 1/46

See application file for complete search history.

(56) References Cited

U.S. PATENT DOCUMENTS

| | | | |
|---|---|---|---|
| 3,627,502 | A | 12/1971 | Rees et al. |
| 3,884,336 | A | 5/1975 | Williamson |
| 6,220,335 | B1 | 4/2001 | Folder et al. |

(Continued)

FOREIGN PATENT DOCUMENTS

| | | | |
|---|---|---|---|
| JP | 2000087489 | A | 3/2000 |

OTHER PUBLICATIONS

ASTM A786/A786M-05,"Standard Specification for Hot-Rolled Carbon, Low-Alloy, High-Strength Low Alloy, and Alloy Steel Floor Plates" ASTM International, Oct. 2005.

(Continued)

*Primary Examiner* — Kevin E Yoon

(74) *Attorney, Agent, or Firm* — Hahn Loeser & Parks LLP

(57) ABSTRACT

A method of making floor plate includes assembling a pair of casting rolls laterally disposed to form a nip, assembling a hot rolling mill downstream of the nip having work rolls with a surface pattern forming the negative of a raised slip-resistant pattern desired in a floor plate, introducing molten metal through at least one metal delivery nozzle to form a casting pool supported on the casting rolls above the nip; counter rotating the casting rolls to form shells on the casting surfaces of the casting rolls to cast metal strip of less than 2.2 mm thickness downwardly from the nip, and delivering the cast metal strip to and through the hot rolling mill to form by the negative of the slip-resistant pattern on the work rolls a raised slip-resistant pattern of between 0.3 and 0.7 mm in height in a floor plate of less than 1.7 mm thickness.

9 Claims, 5 Drawing Sheets

(56) References Cited

U.S. PATENT DOCUMENTS

| | | | | |
|---|---|---|---|---|
| 7,048,033 | B2 | 5/2006 | Blejde et al. | |
| 7,485,196 | B2 | 2/2009 | Blejde et al. | |
| 8,122,937 | B2 * | 2/2012 | Eastman ..... | B22D 11/0674 164/428 |
| 8,141,618 | B2 | 3/2012 | Blejde et al. | |
| 2003/0029599 | A1 | 2/2003 | Poirier et al. | |
| 2004/0177945 | A1 | 9/2004 | Blejde et al. | |
| 2006/0124271 | A1 | 6/2006 | Schlichting et al. | |
| 2014/0366602 | A1 | 12/2014 | Fang et al. | |
| 2014/0367000 | A1 | 12/2014 | Kamat et al. | |

OTHER PUBLICATIONS

"The Hot Rolling Process," CSI, Jul. 30, 2008.
Nucor Surestride Floor Plate, http://www.nucor-sheetmills.com/productpricing.aspx?p=22, Sep. 11, 2010.
PCT/US15/64614 International Search Report and Written Opinion dated Feb. 4, 2016.
PCT/US15/64614 International Preliminary Report on Patentability dated Jun. 20, 2017.

* cited by examiner

SYSTEM FOR MAKING THIN FLOOR PLATE

This patent application is a continuation of U.S. Ser. No. 14/963,305, filed on Dec. 9, 2015, which claims priority to U.S. Provisional Application No. 62/094,920, filed Dec. 19, 2014, which is incorporated herein by reference.

BACKGROUND AND SUMMARY

This invention relates to the method for making thin quality floor plate.

Steel floor plates have a wide range of useful applications, including: construction, public and private walkways, ramps, and stair treads. Steel floor plates should be sturdy and rugged providing impact resistance and feature treading to prevent slips and falls. In the past, floor plates have been relatively thick with a relatively high slip-resistant pattern to inhibit slips by users trafficking the floor plates. The effort has been to make floor plates that are thinner (and in turn much less expensive) yet are sufficiently sturdy and moveable and provide a such raised slip-resistant pattern to be effective in use.

In a twin roll caster, molten metal is introduced between a pair of counter-rotated, internally cooled casting rolls so that metal shells solidify on the moving roll surfaces, and are brought together at the nip between them to produce a solidified strip product, delivered downwardly from the nip between the casting rolls. The term "nip" is used herein to refer to the general region at which the casting rolls are closest together. The molten metal, is poured from a ladle through a metal delivery system comprised of a tundish and a core nozzle located above the nip to form a casting pool of molten metal, supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

Presently disclosed is a method for making floor plate comprising: (a) assembling a pair of casting rolls laterally disposed to form a nip between them with side dams at the end portions of the casting rolls adapted to maintain a molten metal pool supported above the nip by the casting rolls; (b) assembling a hot rolling mill downstream of the nip having work rolls with a pattern thereon forming the negative of a raised slip-resistant pattern desired in a floor plate between 0.3 and 0.7 mm in height; (c) introducing molten metal from a metal delivery system through at least one elongated metal delivery nozzle to form a casting pool supported on the casting rolls above the nip; (d) counter rotating the casting rolls to form shells on the casting surfaces of the casting rolls brought together at the nip to cast metal strip of less than 2.2 mm thickness downwardly from the nip; and (e) delivering the cast metal strip to and through the hot rolling mill to form by the negative of the slip-resistant pattern on the work rolls a raised slip-resistant pattern of between 0.3 and 0.7 mm in height in a floor plate of less than 1.7 mm thickness. Further, the delivered cast metal strip may be such as to provide floor plate greater than 0.7 or greater than 1.0 mm in thickness. The delivered cast metal strip may be silicon killed such as to provide a floor plate with less than 0.008 aluminum.

BRIEF DESCRIPTION OF THE DRAWINGS

The accompanying drawings illustrate the invention in which.

DETAILED DESCRIPTION OF THE DRAWINGS

Figure 1:
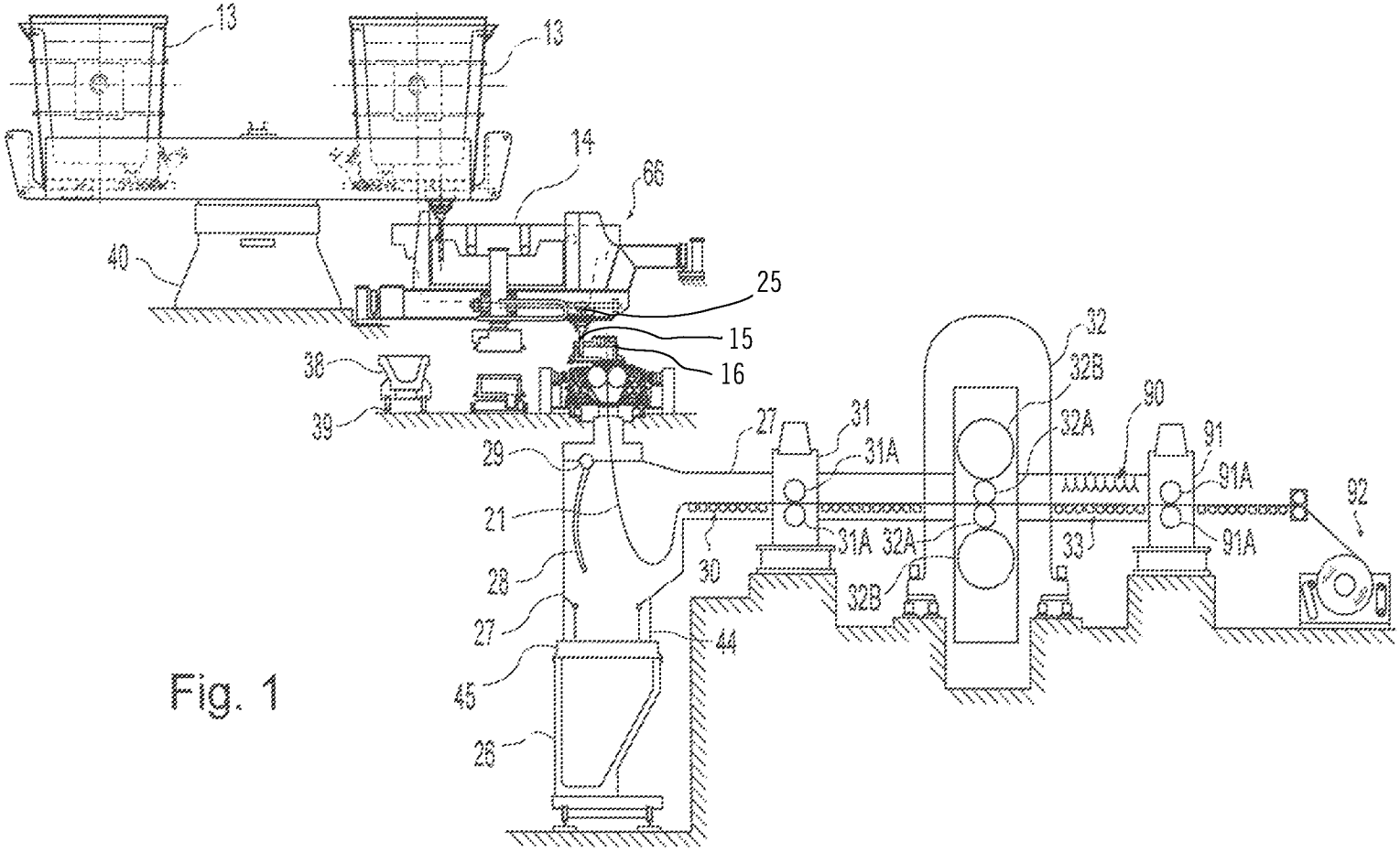
FIG. 1 is a diagrammatical side view of twin roll caster system employing the present twin roll caster.
Figure 2:
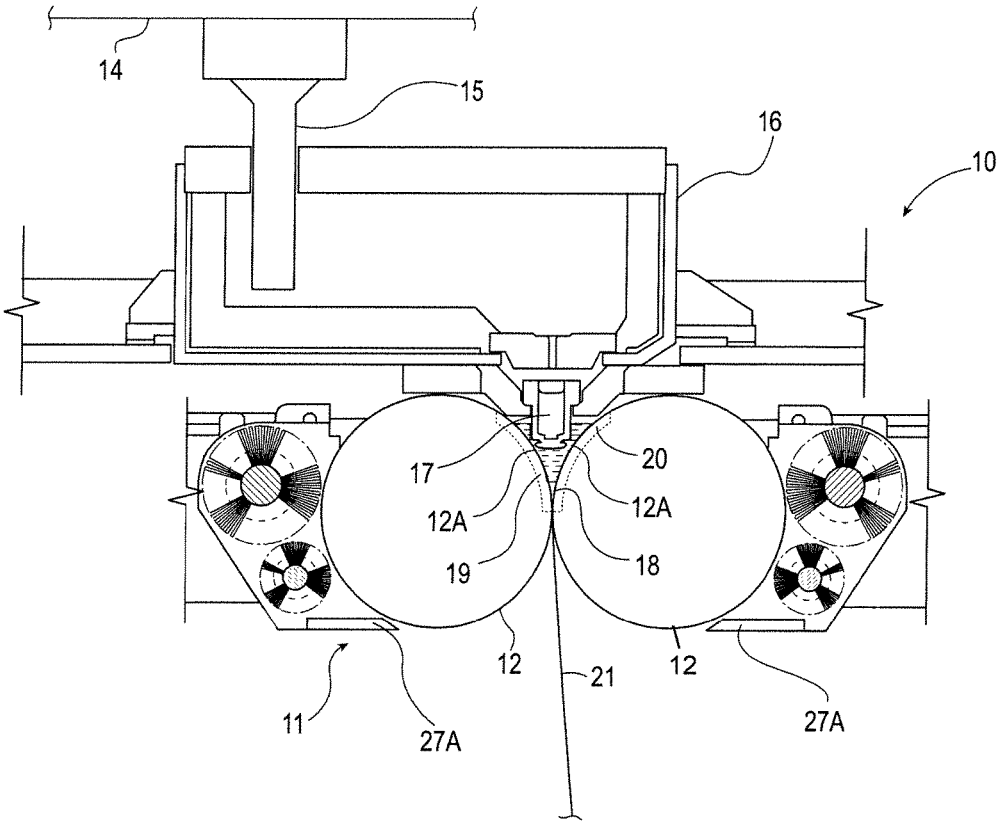
FIG. 2 is a partial sectional view through the casting rolls mounted in a roll cassette in the casting position of the caster system of FIG. 1.

Referring to FIGS. 1 and 2, a twin roll caster system for continuously casting thin steel strip is comprised of a main machine frame 10 that stands up from the factory floor and supports a roll cassette module 11 with a pair of counter-rotatable casting rolls 12 mounted thereon. The casting rolls 12 have shaft portions (not shown) and casting surfaces 12A laterally positioned to form a nip 18 there between. The casting rolls 12 are mounted on the roll cassette 11 for ease of operation and movement of the casting rolls. The roll cassette facilitates movement of the casting rolls 12 ready for casting from a setup position to an operative casting position in the caster as a unit, and ready removal of the casting rolls 12 from the casting position when the casting rolls are to be replaced. The roll cassette have a desired configuration to perform that functions of set up, movement and operation of the casting rolls in the casting position in the twin roll caster.

Molten metal is supplied from a ladle 13 through a metal delivery system, with a movable tundish 14 and a transition piece or distributor 16. From the distributor 16, the molten metal is delivered to at least one metal delivery nozzle 17, or core nozzle, positioned between the casting rolls 12 above the nip 18. Molten metal discharged from the delivery nozzle 17 forms casting pool 19 of molten metal above the nip 18 supported on the casting surfaces 12A of the casting rolls 12. The casting pool 19 is confined on the casting rolls by side closures or side dams 20 (shown in dotted line in FIG. 2) positioned against the ends of the casting rolls 12. The upper surface of the casting pool 19 (generally referred to as the "meniscus" level) generally rises above the lower portions of delivery nozzle 17 so that the lower part of the delivery nozzle 17 is immersed in the casting pool 19. The casting area above the casting pool 19 provides a protective atmosphere to inhibit oxidation of the molten metal in the casting pool.

The ladle 13 typically is of a conventional construction supported on a rotating turret 40. For metal delivery, the ladle 13 is positioned above a movable tundish 14 positioned adjacent the casting area to fill the tundish with molten metal. The movable tundish 14 may be positioned on a tundish car 66 capable of transferring the tundish from a heating station (not shown), where the tundish is heated to near a casting temperature, to the casting position. A tundish guide, such as rails, may be positioned beneath the tundish car 66 to enable moving the movable tundish 14 from the heating station to the casting position.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

The casting rolls 12 are internally water cooled and the casting rolls 12 are counter-rotated to solidify metal shells on the casting surfaces 12A as the casting surfaces 12A move into and through the casting pool 19 with each revolution of the casting rolls 12. The shells formed on the casting surfaces 12A are brought together at the nip 18 between the casting rolls 12 to form a solidified thin cast strip product 21 delivered downwardly from the nip 18.

FIG. 1 shows the twin roll caster producing thin cast strip 21, which passes across a guide table 30 to a pinch roll stand 31, comprising pinch rolls 31A. Upon exiting the pinch roll stand 31, the thin cast strip pass through a hot rolling mill 32, comprising a pair of work rolls 32A with backup rolls 32B, forming a gap adapted to hot roll the cast strip delivered from the casting rolls, where the cast strip is reduced to a desired thickness, and improve the strip surface and the strip flatness. The work surfaces of the work rolls 32A have negative patterns of the desired slip-resistant pattern on the floor plates to be produced. The hot rolled cast strip then passes onto a run-out table 33, where it may be cooled by contact with a coolant, such as water, supplied via water jets 90 or other suitable means, and/or by convection and radiation. In any event, the hot rolled cast strip may then pass through a second pinch roll stand 91 having rollers 91A to provide tension on the cast strip, and then to a coiler 92.

At the start of the casting campaign, a short length of imperfect strip is typically produced as casting conditions stabilize. After continuous casting is established, the casting rolls are moved apart slightly and then brought together again to cause the leading end of the cast strip to break away forming a clean head end of the cast strip to follow. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. During casting, water-cooled apron 28 normally hangs downwardly from a pivot 29 to one side in the enclosure 27 and is swung into position to guide the clean end of the cast strip 21 onto the guide table 30 and feed the strip to the pinch roll stand 31. The apron 28 is then retracted back to its hanging position to cause the cast strip 21 to hang in a loop beneath the casting rolls in enclosure 27 before it passes onto the guide table 30 where it engages a succession of guide rollers.

An overflow container 38 may be provided beneath the movable tundish 14 to receive molten material that may spill from the tundish. As shown in FIG. 1, the overflow container 38 may be movable on rails 39 or another guide such that the overflow container 38 is placed beneath the movable tundish 14 as desired in casting locations. Additionally, an overflow container (not shown) may be provided adjacent the distributor 16.

The sealed enclosure 27 is formed by a number of separate wall sections that assembled together with sealed connections to form a continuous enclosure wall that permits control of the atmosphere within the enclosure during casting. Additionally, the scrap receptacle 26 may be capable of attaching to the enclosure 27 so that the enclosure to provide a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal," "sealed," "sealing," and "sealingly" in reference to the scrap receptacle 26, enclosure 27, and related features may not be a complete seal so as to prevent leakage, but rather is usually provides less than perfect seal to allow control and support of the atmosphere within the enclosure as desired with some tolerable leakage.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 may be movable between a sealing position in which the rim portion engages the scrap receptacle, and a clearance position in which the rim portion 45 is disengaged from the scrap receptacle. Additionally, the caster or the scrap receptacle may include a lifting mechanism to raise the scrap receptacle into sealing engagement with the rim portion 45 of the enclosure, and then lower the scrap receptacle into the clearance position. When sealed, the enclosure 27 and scrap receptacle 26 are filled with a desired gas, such as nitrogen, to reduce the amount of oxygen in the enclosure to generally less than 5% and provide a protective atmosphere during casting of strip.

The enclosure 27 may include an upper collar portion supporting a protective atmosphere immediately beneath the casting rolls in the casting position. When the casting rolls 12 are in the casting position, the upper collar portion 27A is moved to the extended position closing the space between a housing portion adjacent the casting rolls 12, as shown in FIG. 2, and the enclosure 27. The upper collar portion may be provided within or adjacent the enclosure 27 and adjacent the casting rolls, and may be moved by a plurality of actuators (not shown) such as servo-mechanisms, hydraulic mechanisms, pneumatic mechanisms, and rotating actuators.

A method for making floor plate may comprise the following steps: (a) assembling a pair of casting rolls laterally disposed to form a nip between with side dams at the ends of the casting rolls to maintain a molten metal pool supported above the nip by the casting rolls; (b) assembling a hot rolling mill downstream of the nip having work rolls with a pattern thereon forming the negative of a raised slip-resistant pattern desired in a floor plate between 0.3 and 0.7 mm in height; (c) introducing molten metal from a metal delivery system through an elongated metal delivery nozzle to form a casting pool supported on the casting rolls above the nip; (d) counter rotating the casting rolls so as to form shells on the casting surfaces of the casting rolls brought together at the nip to cast metal strip of preferably less than 2.2 mm thickness downwardly from the nip; and (e) delivering the cast metal strip to and through the hot rolling mill to form by the negative on the work rolls of the slip-resistant pattern desired in the floor plate between 0.3 and 0.7 mm of less than 1.7 mm thickness. Further, the delivered cast metal strip may be such as to provide floor plate greater than 0.7 or greater the 1.0 mm in thickness. The delivered cast metal strip may be silicon killed such as to provide a floor plate with less than 0.008 aluminum. Further the floor plate of the current disclosure may contain a total oxygen content of greater than 50 ppm.

The slip resistant pattern form in the floor plate may be ASTM A786M-2004, pattern 4. ASTM A786M covers carbon high-strength, low-alloyed and alloyed steel plate intended for flooring, stairs, transport equipment and other purposes. Steel plate under ASTM A786M shall be manufactured lenticular-riffled. ASTM A786 Steel Floor Plate has a raised diamond lug pattern that provides excellent skid resistance for a wide range of applications commonly used in stairs, walkways, ramps and entrances where 'rough' or 'high-wear' surfaces are preferred. A786 floor plate is available as 4-Way patterned plates, which provide maximum skid resistance with an easy to clean surface. A786 4-Way floor plates may be used for safety flooring on docks, ramps, mezzanines, stair treads catwalks, trench covers, walkways, ornamental projects and other surfaces that require skid resistance with an easy to clean surface.

The floor plate may have a density between 2.0 and 2.2 lbs./ft.$^2$. In other embodiments, the floor plate may have a density of between 2.5 and 2.7 lbs./ft.$^2$.

Figure 3A:
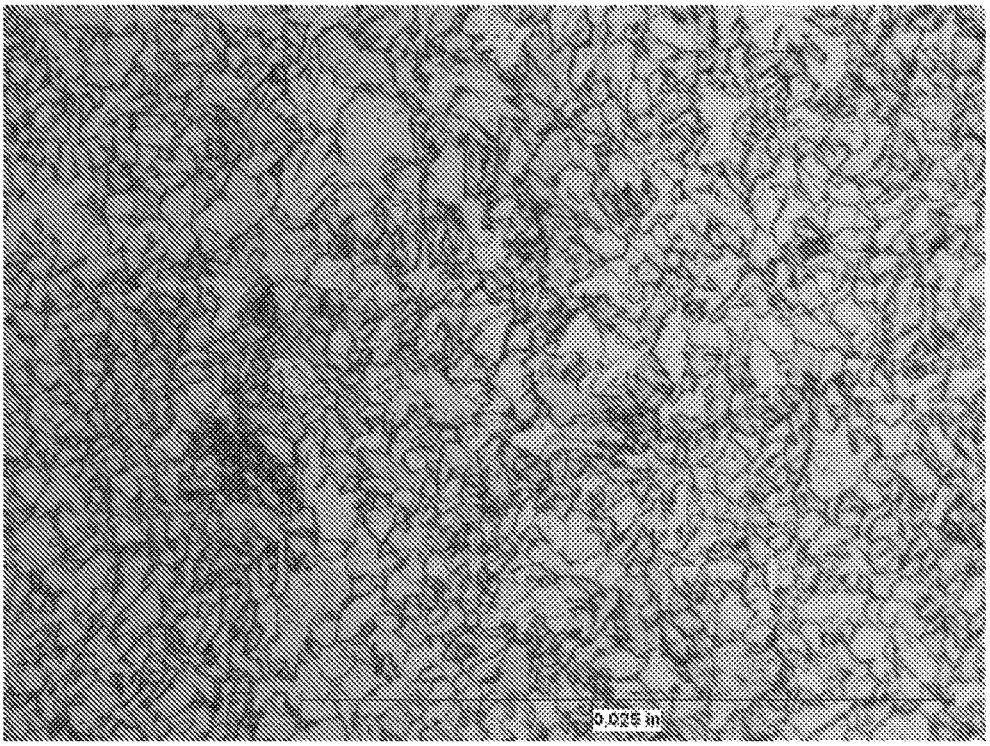
FIG. 3A is a micrograph of the base material of a floor plate.
Figure 3B:
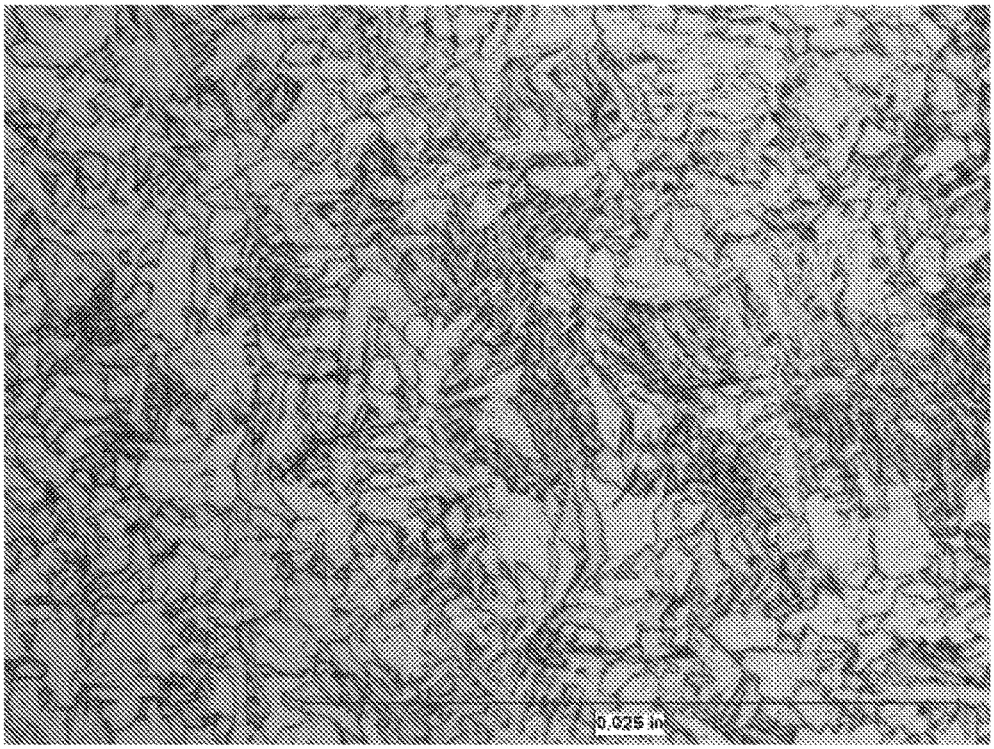
FIG. 3B is a micrograph of the lug of a floor plate.

There is shown in FIGS. 3A and 3B micrographs of base material and lugs of a floor plate taken on longitudinal/transverse directions for plates of 0.043 inches and 0.061 inches in thickness.

Tensile testing was done on a series of floor plates for a range of differing base thicknesses ranging from 0.042 to 0.066 inches. The resulting tensile properties are represented in the table below:

| | | | Hardness | | % | | |
|---|---|---|---|---|---|---|---|
| Heat | Direction | Thickness | Top | Bottom | Tensile | Elongation | Yield |
| 429582-1 | trans | 0.0661 | 62 | 67 | 59.618 | 21.057 | 40.471 |
| 429582-2 | trans | 0.0623 | 61 | 66 | 59.491 | 20.767 | 40.496 |
| 429582-3 | trans | 0.0612 | 62 | 65 | 59.306 | 17.944 | 41.068 |
| 429582-7 | trans | 0.0423 | 59 | 48 | 57.208 | 15.754 | 39.285 |
| 429586-2 | trans | 0.0461 | 56 | 37 | 50.037 | 16.085 | 34.564 |
| 429586-3 | trans | 0.0434 | 60 | 58 | 61.474 | 15.108 | 43.988 |
| 429586-5 | trans | 0.0544 | 61 | 70 | 58.31 | 20.091 | 42.013 |
| 429586-6 | trans | 0.0561 | 53 | 55 | 57.449 | 20.14 | 39.525 |
| 429586-6 | long | 0.0604 | 62 | 55 | 54.333 | 20.467 | 36.276 |
| 429586-8 | trans | 0.0508 | 56 | 56 | 58.024 | 15.968 | 41.032 |
| 429586-8 | long | 0.0491 | 60 | 55 | 57.851 | 14.882 | 40.168 |

Figure 4:
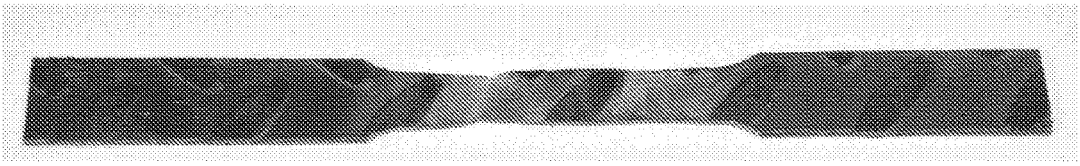
FIG. 4 is a top view of a section of floor plate subjected to tensile testing.

There is shown in FIG. 4 an exemplary section of floor plate subjected to tensile testing, where two necking regions, 1 and 2, are seen, as compared to a flat cast strip without lugs, which generally forms one necking region under tensile testing. It is believed that the lugs provide for uneven strain across the testing area and allow for multiple necking regions.

Figure 5A:
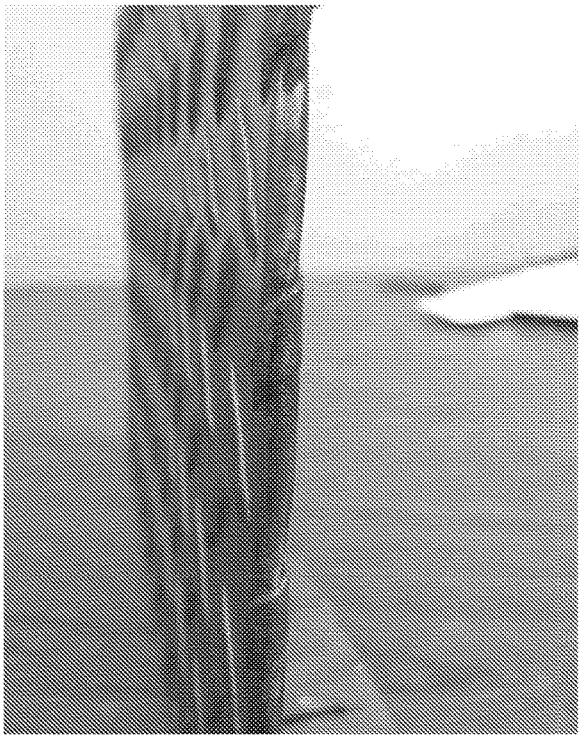
FIG. 5A is a side view of a floor plate subjected to a hem (zero 'T') bend.

There is shown in FIG. 5A a floor plate subjected to a hem (zero 'T') bend.

Figure 5B:
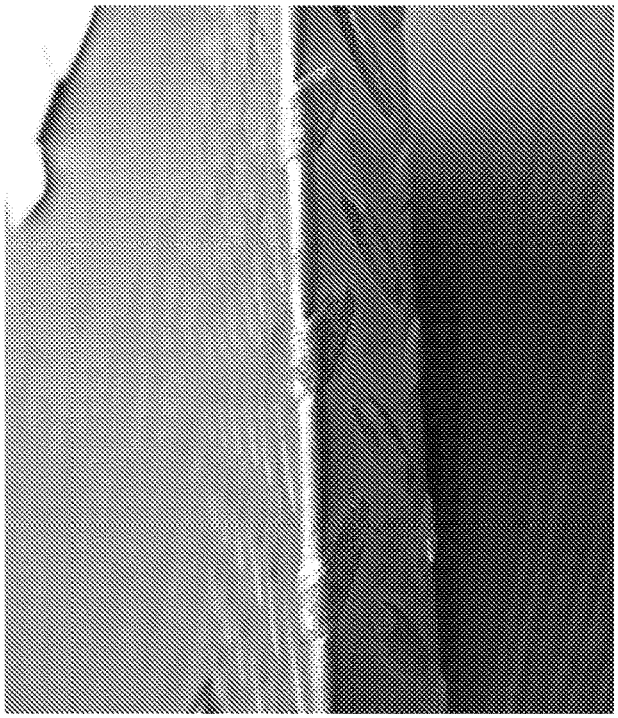
FIG. 5B is an end view of a floor plate subjected to a greater than 90° bend.

There is shown in FIG. 5B a floor plate subjected to a greater than 90° bend.

Figure 5C:
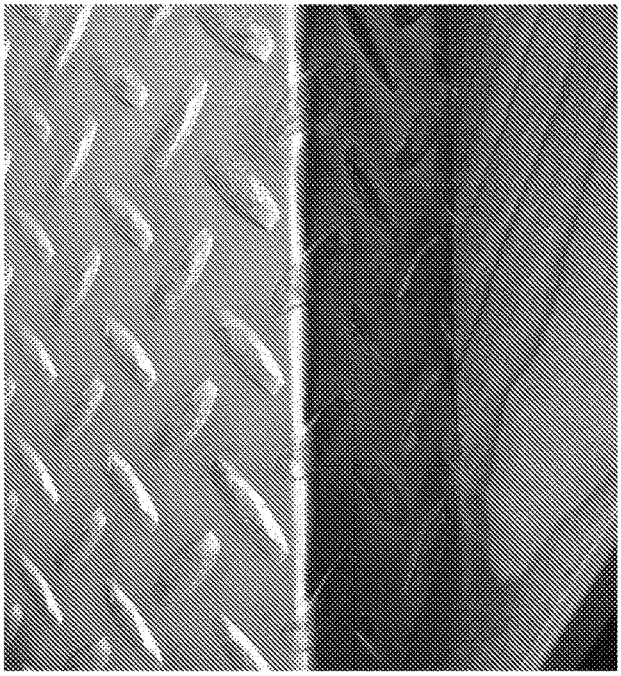
FIG. 5C is an end view of a floor plate subjected to a 90° bend.

There is shown in FIG. 5C a floor plate subjected to a 90° bend.

FIGS. 5A,5B and 5C demonstrate that the floor plate of the present disclosure exhibits excellent ductility.

While the invention has been illustrated and described in detail in the foregoing drawings and description, the same is to be considered as illustrative and not restrictive in character, it being understood that only illustrative embodiments thereof have been shown and described, and that all changes and modifications that come within the spirit of the invention described by the following claims are desired to be protected. Additional features of the invention will become apparent to those skilled in the art upon consideration of the description. Modifications may be made without departing from the spirit and scope of the invention.

What is claimed is:

1. A system for making a thin floor plate comprising:

a pair of casting rolls laterally disposed to form a nip between them and between side dams adapted to maintain a molten metal pool supported above the nip by the casting rolls and to discharge formed strip downwardly through the nip, the casting rolls capable of being counter rotated to form shells on casting surfaces of the casting rolls brought together at the nip to cast metal strip of less than 2.2 mm thickness downwardly from the nip; and a single hot rolling mill downstream of the nip, the single hot rolling mill including a single pair of work rolls, one work roll of the pair of work rolls including a surface pattern forming a negative of a raised slip-resistant pattern desired in a floor plate between 0.3 and 0.7 mm in height, with a delivered floor plate thickness of less than 1.7 mm.

2. The system of claim 1, further comprising a metal delivery system for delivering molten metal to an elongated delivery nozzle disposed in operable relation to the metal delivery system for forming a casting pool supported on the casting roll above the nip.

3. The system of claim 1, where the delivered floor plate is greater than 0.7 mm in thickness.

4. The system of claim 3, where the delivered floor plate has a slip resistant pattern formed as specified in ASTM A786M-2004, pattern 4.

5. The system of claim 1, where the delivered floor plate is greater than 1.0 mm in thickness.

6. The system of claim 5, where the delivered floor plate has a slip resistant pattern formed as specified in ASTM A786M-2004, pattern 4.

7. The system of claim 1, where the delivered floor plate has a slip resistant pattern formed as specified in ASTM A786M-2004, pattern 4.

8. The system of claim 1, where in addition to the single hot rolling mill only two additional pairs of rolls are arranged along the cast metal strip after the nip, the two additional pairs of rollers forming a first and a second pair of pinch rolls, where the cast metal strip is directed from the nip directly to the first pair of pinch rolls, directly thereafter to the single hot rolling mill, and directly thereafter to the second pair of pinch rolls.

9. The system of claim 1, further comprising a coiler for coiling the delivered floor plate.

* * * * *